United States Patent [19]

Hutton et al.

[11] 3,949,507

[45] Apr. 13, 1976

[54] TOP LOCK MECHANISM FOR BREAK-OPEN FIREARM

[75] Inventors: James Cameron Hutton; Merle Francis Carter, both of Mohawk, N.Y.

[73] Assignee: Remington Arms Company, Inc., Bridgeport, Conn.

[22] Filed: July 22, 1974

[21] Appl. No.: 490,514

[52] U.S. Cl. ..... 42/44

[51] Int. Cl.[2] ..... F41C 11/08

[58] Field of Search ..... 42/44, 45, 40

[56] References Cited

UNITED STATES PATENTS 1,434,628 11/1922 Petrik ..... 42/40

FOREIGN PATENTS OR APPLICATIONS 173,319 12/1921 United Kingdom ..... 42/44

918,220 10/1946 France ..... 42/44

54,513 10/1949 France ..... 42/44

*Primary Examiner*—Charles T. Jordan

*Attorney, Agent, or Firm*—John H. Lewis, Jr.; Nicholas Skovran

[57] ABSTRACT

A break-open firearm where the frame and the barrel assembly are locked in place by a sliding top lock. A top lock lever is pivotally connected to the gun frame and is operatively connected to the top lock by a helical coil spring which biases the top lock forwardly into locking position when the top lock lever is moved in a direction which decreases the diameter of the coil spring. Other embodiments of the invention provide for the nelical coil spring to be connected to the frame and to the top lock lever and to the frame and the top lock. In each case, the result is that the helical coil spring is the instrument to bias the top lock forward.

20 Claims, 12 Drawing Figures

TOP LOCK MECHANISM FOR BREAK-OPEN FIREARM

This invention relates to an improvement in break-open firearms, i. e. firearms where the gun frame and barrel assembly are pivoted together to permit relative pivotal movement therebetween on a horizontal axis.

More specifically, the invention relates to an improved top lock which secures and locks the gun frame and barrel assembly in the closed or operative position. Still more specifically, the invention relates to the use of a torsion coil spring operatively inserted between the sliding top lock and the frame to bias the top lock forwardly into locking position.

A primary object of the present invention is to provide a simple top lock and top lock lever biasing means which is economical to make and which performs well.

Another object of the present invention is to provide a top lock spring design which biases a top lock of typical appearance forward on to the barrel extension.

Another object is to provide a top lock spring design which allows unrestricted use of the zones beneath the top lock and top tang by the reciprocating parts, e. g. autoloading mechanism.

Another object is to provide a top lock spring design in which essentially two equal forces bias the top lock forwardly thus preventing side movement of the top lock on the frame.

Still another object of the invention is to provide a top lock spring design which holds the top lock lever down vertically on to the frame to prevent vertical movement of the lever.

Break-open firearms and locking means to secure the frame and barrel assembly in closed position are not new. Representative patents in this area are the following U.S. patents: U.S. Pat. No. 1,434,628 issued to B. Petrik on Nov. 7, 1922; U.S. Pat. No. 1,795,223 issued to C. C. Loomis on Mar. 3, 1931; U.S. Pat. No. 2,095,297 issued to L. Stiennon on Oct. 12, 1937; and U.S. Pat. No. 3,636,646 issued to Georges Drevet on Jan. 25, 1972.

These patents show the combination of a gun frame, a barrel assembly — whether it is a single barrel or two barrels, either over and under or side by side — and a sliding top lock which typically is slidably mounted in the frame to move forward and over the rear barrel assembly, locking it down securely. A top lock is typically biased forward by means of a spring, and manually moved rearward via a top lock lever to allow rotation of the barrel assembly.

In the event that it should be desired to use a reciprocating mechanism within the frame (as in the conventional semi-automatic or pump-action firearm), the space below the top lock and below the top tang is not available in prior art firearms—and a typical top lock spring design could not be used. Therefore, the present invention provides a top lock spring design which will bias a top lock of typical appearance forward on to the barrel extension and will allow unrestricted use of the zones beneath the top lock and top tang by reciprocating parts of a semi-automatic or pump type firearm.

As can be seen in the prior art patents cited above, the top lock spring mechanisms tend to be complex and include a large number of small, expensive, precision parts. In some cases, the biasing means urging the top lock forward is positioned on one side of the gun with the result that binding or non-uniform sliding of the top lock in the frame sometimes occurs. The present invention eliminates several parts by combining the functions of these parts in a single torsion-compression helical coil spring. Moreover, by urging the top lock forwardly at two points instead of one, the top lock moves uniformly on the frame and binding is lessened if not eliminated.

In the preferred embodiment, a spring, which acts as both a helical torsion spring and a helical compression spring, acts to bias the top lock and lever. The spring operates between the top lock and the top lock lever which is pivoted in the gun frame with a hollow cylinder section in which the spring is housed. The lower end of the spring engages a slot in the bottom of the cylinder section while the upper looped end of the spring extends radially from the spring center to engage the top lock in a pocket or notch provided on one side of the top lock. With both ends restrained, the spring acts torsionally between the lever and the top lock. The top lock lever has a rounded tooth which engages the top lock in a second pocket or notch located oppositely to the first pocket or notch. The spring is compressed between the lower surface of the top lock and the bottom of the lever cylinder section.

In alternate embodiments of the invention, the helical coil spring acts either directly or indirectly on one side of the top lock to bias the top lock forward. In these embodiments, the advantage of the uniform biasing of the top lock on both sides thereof is missing but nevertheless they are suitable alternatives which should equal in performance prior art top lock devices.

One of such alternate embodiments has one of the free ends of the helical coil spring connected to the top lock lever and the other end connected to the frame —instead of the top lock as shown in the preferred embodiment. In this design, the top lock lever is biased rotationally so that a tooth on the top lock lever engages a notch on one side of the top lock to bias the top lock forward.

In the second alternate embodiment, the lower free end of the helical coil spring is attached to the frame and passes through the top lock lever without biasing the top lock lever in any manner whatever. The top free end of the helical coil spring is rounded (as in the preferred embodiment) and engages a notch on one side of said top lock thus biasing the top lock forward. The tooth on the top lock lever merely rests in an oppositely disposed notch in the top lock so that pivotal movement of the top lock lever can (through the tooth - notch engagement) move the top lock rearward against the bias of ths spring.

In summary the helical torsion spring not only performs the same function as the conventional compression spring of providing a uniform forward bias on the top lock, but it also: 1) rotatably biases the lever to prevent side-movement; 2) vertically holds the lever down on to the frame to prevent vertical movement; 3) provides space beneath the top lock and top tang for the reciprocating parts; and 4) simplifies the top lock bias mechanism from a multiplicity of parts to one part with resultant economy in machining and assembly costs.

With the above and other objects in view, as will appear to those skilled in the art from the following, considered in conjunction with the accompanying drawings and appended Claims, the present invention includes all features disclosed therein which are novel over the prior art.

Figure 1:
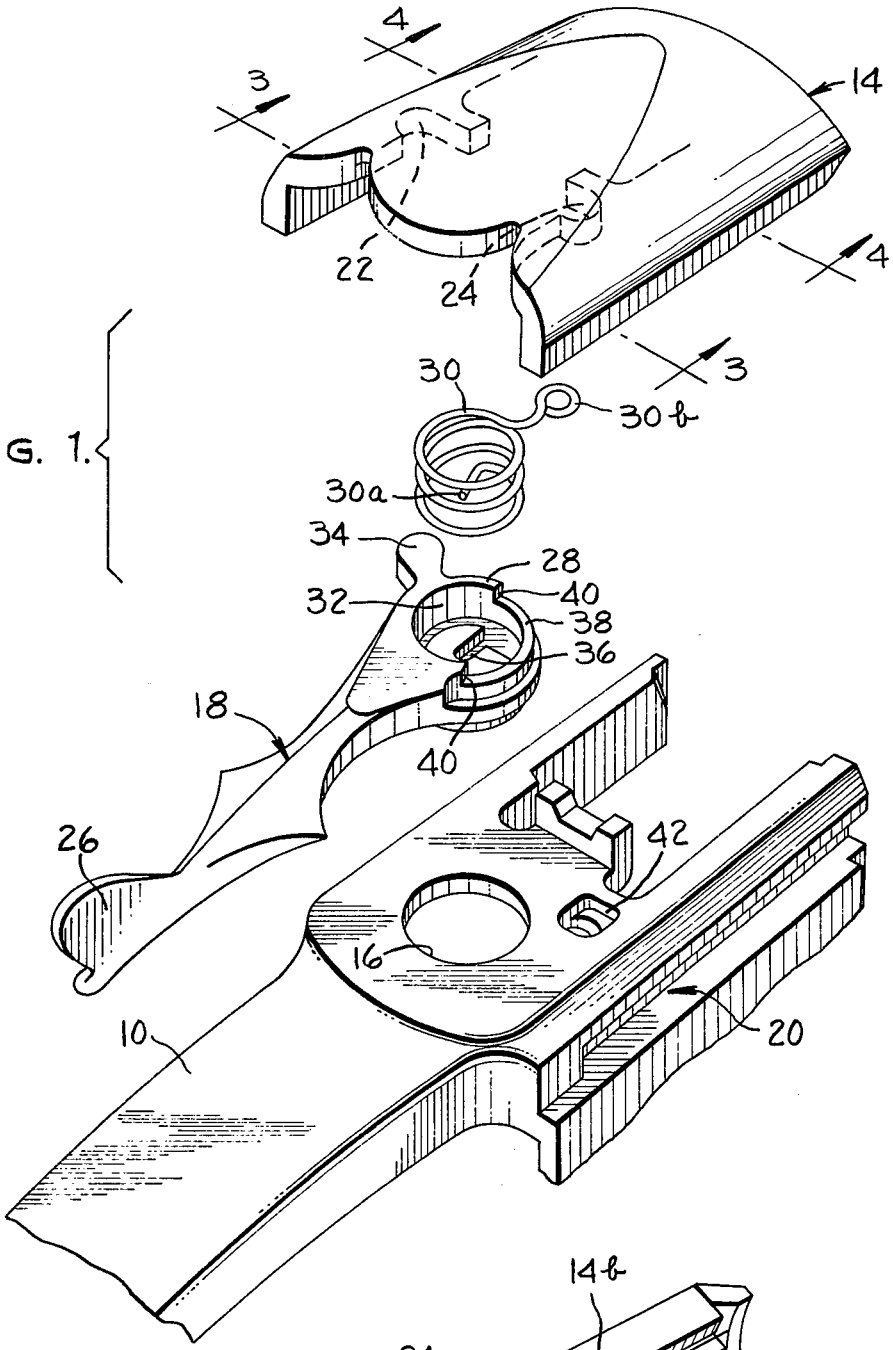
FIG. 1 is an exploded isometric view of a preferred embodiment of the top lock basis mechanism of a break-open firearm.

The specifics of break-open firearms have not been disclosed in order to simplify the specification and limit the disclosure to the real novelty. Top locks of the type shown in the present invention are shown in the patents cited above. Also not disclosed are specifics of the latching mechanism by which the top lock lever is held in the various positions shown in FIGS. 5, 7, and 9. Various latching mechanisms can be utilized with the present invention and again, the inclusion of the details of such latching mechanisms would unnecessarily clutter the drawing without adding anything further to the present inventive concept which is complete in itself.

Figure 10:
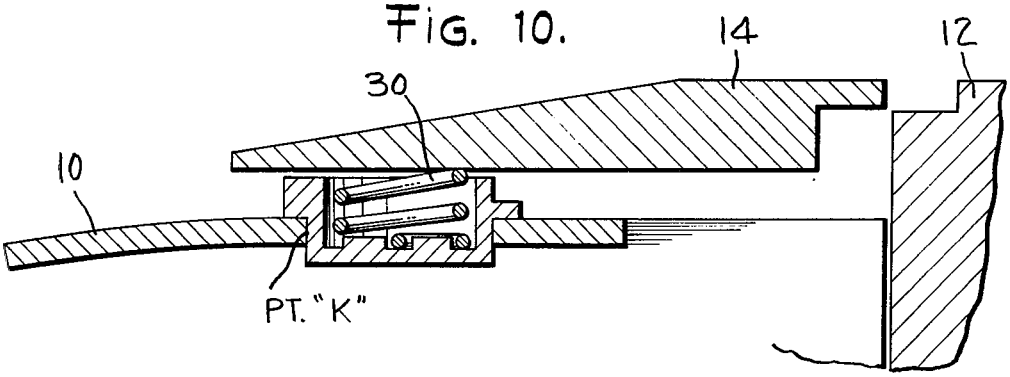
FIG. 10 is a cross-sectional view taken along Line 10—10 in FIG. 9.

FIG. 10 shows the general combination of a frame 10, a barrel assembly 12, and a top lock 14 which is slidably mounted on the frame 10 to engage and secure the rear end of the barrel assembly.

Figure 2:
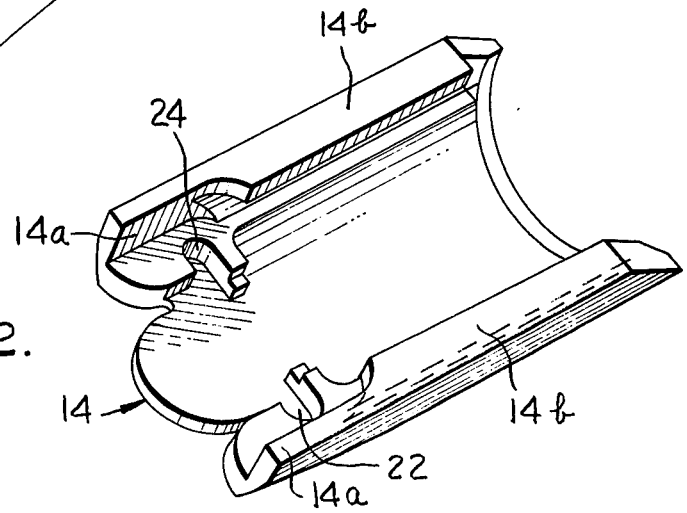
FIG. 2 is an isometric view of the top lock when the top lock is positioned upside down with some cuts and other portions emitted to show the top lock construction more clearly.
Figure 3:
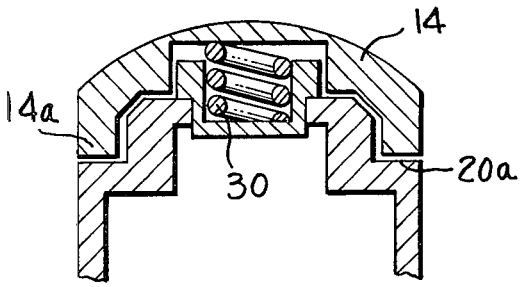
FIG. 3 is a cross-sectional view taken on Line 3—3 of FIG. 1 and passing through the mechanism when the top lock is slidably mounted on the frame.
Figure 4:
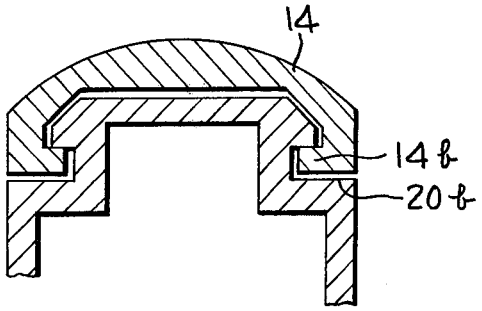
FIG. 4 is a cross-sectional view taken on Line 4—4 of FIG. 1.

FIG. 1 best shows the simplicity of the preferred form of the present invention. The gun frame 10 includes a central circular opening 16 in which the top lock lever 18 is pivotally mounted, as will be explained later. The frame also includes frame guide rails 20 which begin as an ordinary horizontal bearing surface 20*a* (see FIG. 3) and which becomes an undercut portion 20*b* (see FIG. 4) at a point forwardly on said frame. The top lock 14 is slidably mounted on said frame by means of a vertical leg 14*a* at the rear end of said top lock which becomes an inwardly projecting portion 14*b* forwardly thereof and which slides in the undercut portion 20*b* of the frame. As seen in FIG. 1, and FIG. 2, pockets or notches 22 and 24 are provided in the top lock.

Figure 6:
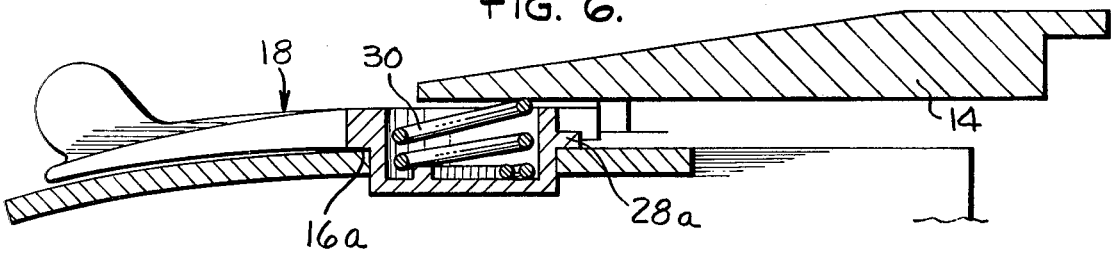
FIG. 6 is a cross-sectional view taken along Line 6—6 in FIG. 5.
Figure 8:
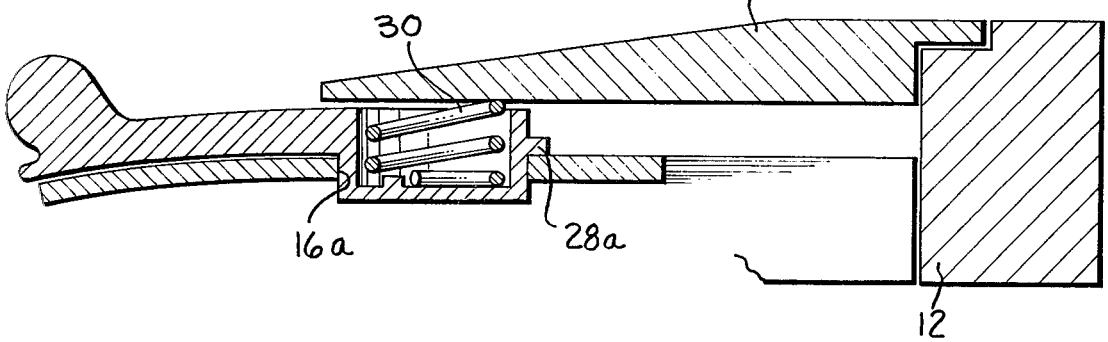
FIG. 8 is a cross-sectional view taken along Line 8—8 in FIG. 7.

The top lock lever 18 is an elongated member having a handle portion 26 at the rear and a hollow cylindrical section 28 at its forward end. FIGS. 6, 8, and 10 show the cylindrical section 28 mounted in the circular opening 16 of the frame. The outside diameter of the cylindrical section is slightly less than the diameter of the opening 16 in the frame so that the lever is supported on the peripheral surface 28*a* of the cylindrical section and the peripheral surface 16*a* of the frame opening (see FIG. 6).

The inside diameter of the cylindrical section in turn is sufficiently greater than the diameter of the unstressed torsion helical spring 30 so that when the torsion spring is positioned within the cylindrical cavity and compressed, and the diameter of the coil is increased, the inner peripheral surfacd 32 of the cylindrical section will provide some lateral support for the torsion spring.

The top lock lever 18 also includes an outwardly extending tooth 34 which engages pocket or notch 22 of the top lock. The top lock lever also includes a slot 36 at the bottom of the cavity caused by the hollow cylindrical section in which the lower free end 30*a* of the torsion spring is engaged. A segment 38 of the hollow cylindrical section is cut away in order to provide stop means 40 which limit the pivotal movement of the upper free end 30*b* of the torsion spring. The free end 30*b* of the torsion spring is turned around to form a loop in order to strengthen the end and provide a rounded surface for engagement in the second pocket or notch 24 of the top lock.

Opening 42 in the frame is utilized for the latching mechanism which secures and holds the top lock in its open position and which is released when it is desired to close and lock the break-open firearm. As mentioned above, the latch is not part of the present invention and is omitted to simplify the understanding of this invention.

Figure 5:
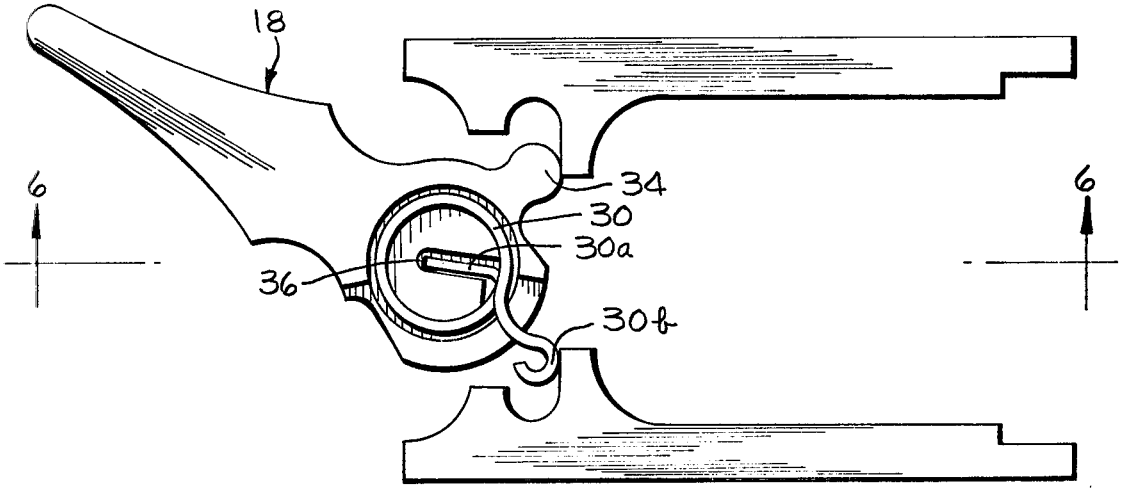
FIG. 5 is a plan view of the top lock, top lock lever and torsion spring when the components are in the preliminary stage of assembly and the torsion spring is unstressed.

With the completion of a description of the invention, it is appropriate at this point to discuss the operation of the device. For assembly, the torsion spring 30 is placed in the top lock lever 18 and rotated until the lower leg 30*a* of the spring 30 engages the slot 36. The angle between the lever tooth 34 and the upper spring end 30*b* is about 90°, with the spring unstressed (see FIG. 5). The top lock lever is placed in the frame with the arm at 30° left of center, placing the tooth 34 and spring end 30*b* each about 45° from center. The top lock is then egaged in the frame guide rails 20 and slide rearward over the lever 18 and spring 30 as shown in FIG. 5. No torsional load is placed on the spring at this point, but the spring is and remains in vertical compression between the lever 18 and the top lock 14, holding the lever down firmly in the frame and smoothing the top lock movement by applying friction between the top lock and the frame, as shown in FIG. 6.

Figure 7:
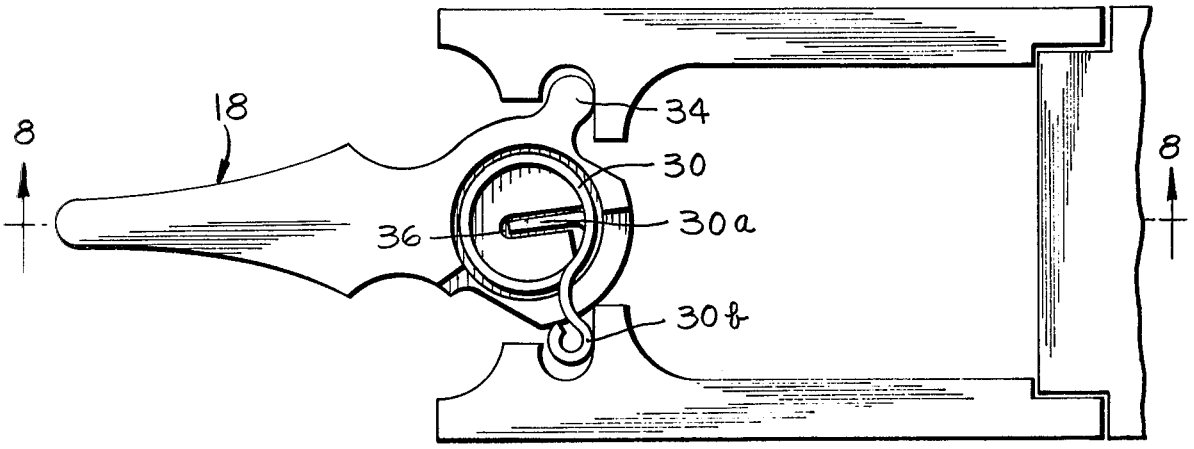
FIG. 7 is a plan view of the top lock, top lock lever and torsion spring with the lever pivoted to the center position thus stressing the torsion spring.

By simultaneously moving the top lock rearward and rotating the lever, the lever tooth 34 and spring 30*b* engage the pockets or notches 22 and 24 in the top lock respectively, as shown in FIG. 7. With the lever aligned with the centerline, the angle between the lever tooth and spring end is about 150°, establishing a torsional load of about 60°. In this position, two equal forces act forward on the top lock, from both the tooth 34 and spring end 30*b*, uniformly biasing the top lock forward without yaw. The forward force is resisted by the barrel extension 12 and the rearward forces act through the lever cylinder bearing on the frame at point K (see FIG. 10).

Figure 9:
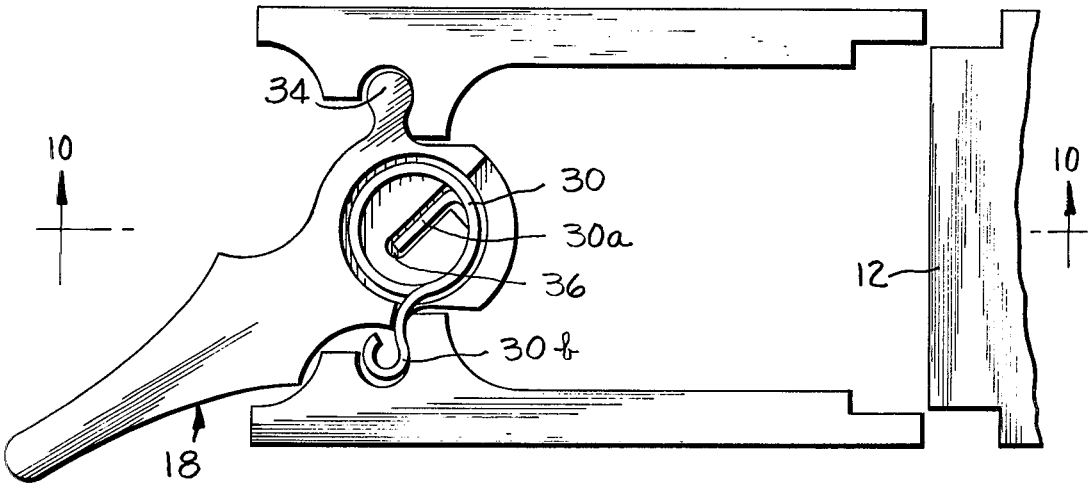
FIG. 9 is a plan view of the top lock, top lock lever, and torsion spring with the lever pivoted to the extreme right thus stressing the torsion spring to its greatest degree under these circumstances.

To "open" the top lock for rotation of the barrel extension, the lever is moved to 30° to the right of centerline, at which position an angle of about 210° is established between the lever tooth 34 and the spring end 30*b* as shown in FIG. 9. It should be noted that 1° of rotation of the lever produces two degress of torsion in the spring and the manual force on the lever is uniform and linear. The angles described obviously may be varied as necessary.

Figure 11:
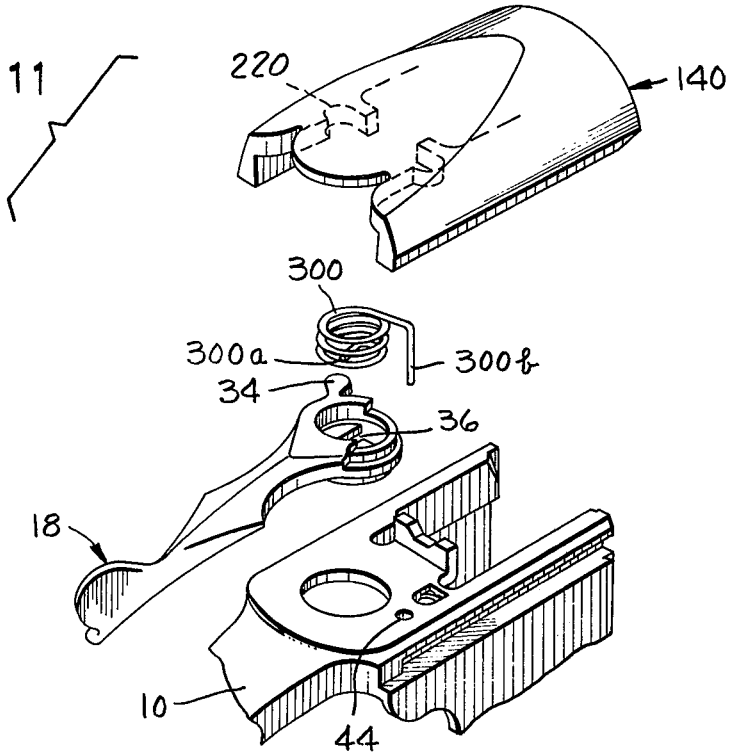
FIG. 11 is an exploded, isometric view of an alternate form of the invention.

A second embodiment of the present invention is shown in FIG. 11. This FIGURE shows the torsion helical coil spring 300 mounted with one free end 300*a* engaged in slot 36 of top lock lever 18 and the other free end 300*b* engaging a hole 44 in the frame 10. The helical coil spring 300 now acts between the lever 18 and the frame 10, biasing the lever in a clockwise rotation. Tooth 34 of the top lock lever presses forward on the top lock 140 by acting in pocket 220. In this way, the lever alone is biased by the torsion spring and the entire top lock mechanism functions satisfactorily.

Figure 12:
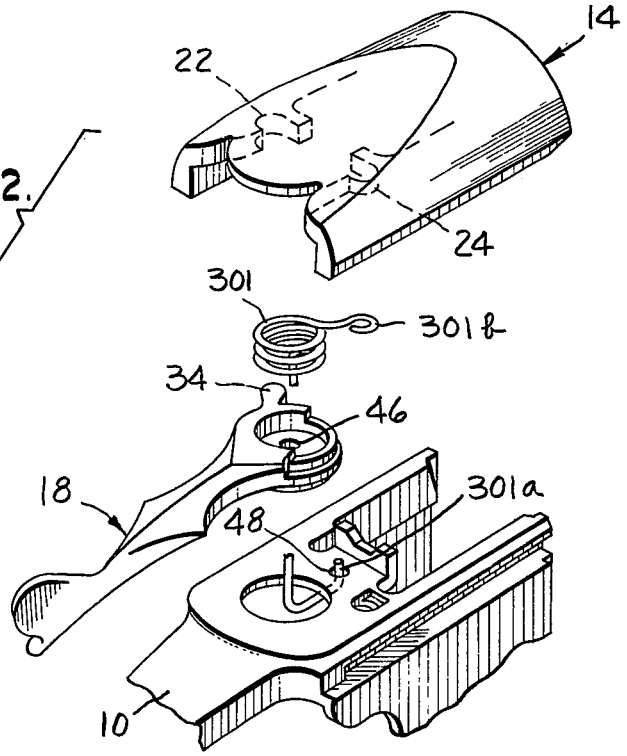
FIG. 12 is an exploded, isometric view of still another alternate form of the invention.

A third embodiment of the invention is shown in FIG. 12. This FIGURE shows a helical coil spring 301 having its upper free end 301*b* engaged in top lock pocket 24 and the lower free end 301*a* passing through an opening 46 of the lever 18 to engage the frame 10 at hole 48. The torsion, helical coil spring 301 therefore now acts between the top lock 14 and the frame 10, simply biasing the top lock forward via pocket 24. Tooth 34 of the top lock lever is a loose fit in the top lock pocket 22 and is used only to pull rearward in opening to top lock. In this way, the top lock alone is biased forward by the spring.

In the preferred design of FIG. 1, etc., the top lock is biased forward by the torsion spring acting through both pockets uniformly. In either of the variations shown in FIGS. 11 and 12, the helical coil spring acts on one side or the other of the top lock—not uniformly. Also in the embodiments of FIGS. 11 and 12, the spring is loaded only one half the degree of rotation than in the preferred design illustrated in FIG. 1.

What is claimed is:

1. In a break-open firearm having a frame and a barrel assembly, a locking device to secure the frame and barrel assembly when the firearm is in the closed firing position and which is actuatable to an open position to permit the frame and barrel assembly to break open and pivot relative to one another, said locking device comprising a top lock, means slidably mounting said top lock on said frame to engage and secure said barrel assembly to said frame when the top lock means is in the forwardmost position and to permit pivoting of said frame and barrel assembly when the top lock is in the rear position, and torsion means biasing said top lock away from said frame into frictional engagement therewith and also biasing said top lock forwardly into securing relationship with said barrel assembly.

2. In a break-open firearm as recited in claim 1, said locking device further comprising a top lock lever, means pivotally mounting said top lock lever on said frame, said torsion means positioned so as to bias said top lever against said top lock thus forcing the top lock to a forward position.

3. In a break-open firearm as recited in claim 2, wherein said torsion means comprises a helical torsion spring which is connected at one free end to said top lock lever and at the other free end to a notch in said top lock.

4. In a break-open firearm as recited in claim 2, wherein said torsion means comprises a helical torsion spring which is connected at one free end to said top lock lever and at the other free end to said firearm frame and which biases said top lock lever against said top lock to force the top lock forwardly.

5. In a break-open firearm as recited in claim 1, said locking device further comprising a top lock lever having means thereon for engaging said top lock, means pivotally mounting said top lock lever on said frame, said torsion means operatively connecting said top lock and said firearm frame.

6. In a break-open firearm as recited in claim 5, wherein said top lever has a cavity therein, said torsion means comprising a helical torsion spring having one of its free ends engaging a notch in said top lock, the other free end attached to said frame, and the main cylindrical portion of the helical torsion spring positioned in and supported in said top lock lever cavity.

7. In a break-open firearm as recited in claim 2, wherein said means slidably mounting said top lock on said frame comprised interengaging means on said top lock and said frame which permits said top lock to move longitudinally on said frame, said means pivotally mounting said top lock lever on said frame comprising an opening in the top surface of said frame and a cylindrical section on said top lock lever which is pivotally mounted in said opening.

8. In a break-open firearm as recited in claim 7, said torsion means comprising a helical torsion spring which is secured at one free end to said top lock lever and at the other free end to a notch in said top lock.

9. In a break-open firearm as recited in claim 8, wherein said top lock lever comprises an outwardly projecting tooth, a second notch in said top lock into which said tooth projects, said first and second notches being positioned on opposite sides of said top lock so that when the top lock lever is in the centrally disposed position, the helical spring acts torsionally to bias the top lock forwardly, said top lock being biased forwardly on the one side by the open end of the helical spring engaging the first notch and on the other side by the tooth engaging the second notch.

10. In a break-open firearm as recited in claim 7, wherein said torsion spring is a helical coil spring, said cylindrical section of said top lock lever being hollow to permit the helical spring to be contained therein, means in said hollow section of said top lock lever to secure one free end of said helical spring so that upon pivotal movement of the top lock lever in the direction which reduces the diameter of the coil, the other free end of the helical spring is secured in a notch in said top lock thus placing the helical spring in torsion so as to bias the top lock forward.

11. In a break-open firearm as recited in claim 7, wherein said torsion spring is a helical coil spring, said cylindrical section of said top lock lever being hollow to permit the helical spring to be contained therein, means in said hollow section of said top lever to secure one free end of said helical spring, means on said firearm frame to secure the other free end of said helical spring so that in the normal, expanded position of the helical coil spring, said top lever is biased against said top lock to move said top lock forward.

12. A break-open firearm having a barrel assembly pivotally mounted to a frame and having a top lock slidably mounted on said frame securing the barrel assembly and frame in closed position, the improvement comprising a top lock lever pivotally mounted on said frame beneath said top lock, torsion means positioned between said top lock and the top lock lever for biasing said top lock forward into barrel assembly-frame locking position when the top lock lever is in one position and forcing said top lock rearward to a non-locking position when the top lever is pivoted to a second position.

13. A break-open firearm as recited in claim 12, wherein said torsion means comprises a helical coil spring, said helical coil spring having a lower free end mounted in a slot in said top lock lever and having an upper free positioned in a notch located on one side of said top lock so that upon pivotal movement of said top lock lever in a direction which reduces the diameter of the coil spring, said helical coil spring acts in torsion to bias said top lock forwardly into barrel assembly-frame locked position.

14. A break-open firearm as recited in claim 13, wherein said top lock lever includes an outwardly extending tooth which is positioned in a second notch in said top lock, said second notch being located on the side of said top lock opposite to said first notch so that upon pivotal movement of said top lock lever, said tooth and said upper free end of said helical coil spring engage said notches to bias said top lock uniformly on said frame to prevent binding thereon.

15. A break-open firearm as recited in claim 12, wherein said torsion means comprises a helical coil spring, said top lock lever comprising an elongated arm ending with a hollow, cylindrical section, said hollow cylindrical section having its inside diameter slightly greater than the outer diameter of the relaxed helical coil spring so that said coil spring can be positioned within said cylindrical section, means in said cylindrical section to secure the lower free end of said coil spring, said frame having an opening therein with a diameter slightly larger than the outside diameter of said top lock lever cylindrical section, said top lock lever cylindrical section being located in said frame opening for pivotal movement therein, a notch in said top lock in which the upper free end of said coil spring is located so that upon pivotal movement of said top lock lever in a direction which reduces the diameter of the coil spring, said spring acts in torsion to bias the top lock forward into barrel assembly-frame locking position.

16. A break-open firearm having a frame, a barrel assembly and a top lock means for locking said frame to said barrel assembly, said top lock means comprising a top lock lever, means pivotally mounting said top lock lever to said frame, a top lock member, means slidably mounting said top lock member on said frame, torsion means for biasing said top lock member into locking position, said torsion means comprising a helical coil spring which is compressed vertically between said top lock member and said top lock lever thus biasing the top lock lever and the associated frame away from the top lock member.

17. A break-open firearm as recited in claim 16, wherein said means mounting said top lock lever to said frame comprises an opening in said frame, said top lock lever having a cylindrical section at one end thereof, said outside diameter of said cylindrical section being of slightly lesser diameter than said opening so that the cylindrical section is supported at its peripheral surface while being pivotally mounted in said opening.

18. A break-open firearm as recited in claim 17, wherein said torsion means comprises a helical coil spring, means connecting one free end of said coil spring to said top lock member, and means connecting the second free end to said top lock lever where upon pivotal movement of said top lock lever in a direction which reduces the diameter of said spring, said top lock member is biased forwardly.

19. A break-open firearm as recited in claim 18, wherein said cylindrical section of said top lock lever is hollow and has an inside diameter slightly greater than the outside diameter of the relaxed, unstressed coil spring so that the inside surface of said cylindrical surface provides support to said coil spring during the stressing and non-stressing phases of operation, said cylindrical section also having its depth less than the height of said relaxed, unstressed coil spring so that when the top lock member is slidably mounted on said frame, the upper end of said coil spring engages the bottom surface of said top lock member thus compressing the coil spring and biasing the top lock member and the frame away from each other.

20. A break-open firearm as recited in claim 16, wherein said top lock member has a pair of notches located on opposite sides thereof, said top lock lever having an outwardly projecting tooth which engages one of said notches while said other notch is engaged by the free end of said coil spring which is not connected to said top lock lever.

* * * * *

UNITED STATES PATENT OFFICE

CERTIFICATE OF CORRECTION

PATENT NO. : 3,949,507

DATED : APRIL 13, 1976

INVENTOR(S) : JAMES CAMERON HUTTON and MERLE FRANCIS CARTER

It is certified that error appears in the above-identified patent and that said Letters Patent are hereby corrected as shown below:

Col. 2, Line 50, "ths" should read as "the". Col. 3, Line 2, "basis" should read as "bias"; Col. 3, Line 6, "emitted" should read as "omitted". Col. 4, Line 11, "surfacd" should read as "surface"; Col. 4, Line 44, "slide" should read as "slid"; Col. 4, Line 53, after spring insert --end-- . Col. 5, Line 2, "degress" should read as "degrees"; Col. 5, Line 26, "to top lock" should read as "the top lock". Col. 6, Line 18, "comprised" should read as "comprises". Col. 7, Line 9, after free insert --end-- .

Signed and Sealed this

*twenty-ninth* Day of *June 1976*

[SEAL]

*Attest:*

RUTH C. MASON
*Attesting Officer*

C. MARSHALL DANN
*Commissioner of Patents and Trademarks*